US005999143A

United States Patent [19]

Glynn

[11] Patent Number: 5,999,143

[45] **Date of Patent: *Dec. 7, 1999**

[54] ANTENNA SYSTEM PARABOLIC REFLECTOR, FLAT PLATE SHROUD AND RADOME

[76] Inventor: James J. Glynn, 143 Cornell Dr., Dennisport, Mass. 02639

[ * ] Notice: This patent issued on a continued prosecution application filed under 37 CFR 1.53(d), and is subject to the twenty year patent term provisions of 35 U.S.C. 154(a)(2).

[21] Appl. No.: 08/625,155

[22] Filed: Apr. 1, 1996

Related U.S. Application Data

[63] Continuation of application No. 08/298,931, Aug. 31, 1994, abandoned.

[51] Int. Cl.[6] ..... H01Q 19/12

[52] U.S. Cl. ..... 343/840; 343/872; 343/915

[58] Field of Search ..... 343/840, 915, 343/872, 873, 912; H01Q 19/12, 15/20

[56] References Cited

U.S. PATENT DOCUMENTS

| | | | |
|---|---|---|---|
| 3,599,218 | 8/1971 | Williamson | 343/840 |
| 3,707,720 | 12/1972 | Staehlin et al. | 343/840 X |
| 3,740,755 | 6/1973 | Grenzeback | 343/840 |
| 4,364,053 | 12/1982 | Hotine | 343/840 X |
| 4,683,475 | 7/1987 | Luly | 343/915 |
| 4,764,779 | 8/1988 | Sato et al. | 343/915 X |
| 4,804,972 | 2/1989 | Schudel | 343/840 |

*Primary Examiner*—Don Wong
*Assistant Examiner*—Tho Phan
*Attorney, Agent, or Firm*—Robert T Dunn

[57] ABSTRACT

In a parabolic reflector system for directing or receiving radiation from or to a radiation feed, having a parabolic reflector surface defining a parabolic reflector axis, a parabolic reflector focus and a radiation aperture, wherein the parabolic reflector has a flat plate shroud attached thereto at the aperture thereof and a radome covering the shroud aperture.

8 Claims, 4 Drawing Sheets

NOTES: 41 TO 48 ARE METAL PANELS OF SHROUD; AND
51 TO 58 (REFLECTOR SKIRTS) ARE PLASTIC
THAT IS METALIZED (35) ON THE INSIDE.

LARGE DIAMETER ANTENNA
(FLAT PLATE SHROUD)

ANTENNA SYSTEM PARABOLIC REFLECTOR, FLAT PLATE SHROUD AND RADOME

This application is a Continuation of co-pending application Ser. No. 08/298,931, filed Aug. 31, 1994, now abandoned, entitled, ANTENNA SYSTEM PARABOLIC REFLECTOR SHAPE FORMING FOR IMPROVED PERFORMANCE.

BACKGROUND OF THE INVENTION

This invention relates to reflector type radio frequency (RF) antennas used for communications purposes and more particularly to such antennas having a parabolic shaped reflector, a shroud and a radome.

Parabolic reflector type antennas developed and currently produced for satellite ground applications use are made by forming aluminum sheet on a mandrel by a spinning process. Satellite earth terminal antennas may be forty feet or more in diameter and are fabricated using preformed metal panels or are plastic molded on parabolic forms. The plastic reflectors are metalized to make the surface reflective using any of many well known techniques.

High tolerance parabolic reflectors for high efficiency operation must be very stiff to maintain the manufactured parabolic shape regardless of single or multi-piece construction or size. Reflectors of two or more piece construction of metal or plastic require greater effort and costs than the same size reflector of single piece construction for the same surface precision. However, two or more piece construction of reflectors of diameter larger than about two feet have significant saving in storage and shipping. All must meet the same operating surface tolerances.

One class of parabolic reflector antenna that is known to produce superior radiation performance is the so called "high performance" antenna. This class consists of a parabolic reflector, a reflective cylindrical shroud and a planar radome covering the shroud aperture. Cylindrical shrouds are a development of "tunneling" techniques to reduce unwanted side and back radiation from a transmitting antenna and unwanted side and back radiation reception by a receiving antenna. The shroud as used on high performance parabolic reflector antennas has been a cylinder the same diameter as the reflector to which it attaches at one end and the radome covers the other end of the cylinder.

The radome is a transparent microwave window and may be rigid plastic or a pliable material mated to the cylindrical shroud open aperture by various means.

High performance signifies much reduced side and rear radiation characteristics of the shrouded antenna, as compared with a standard, (average), unshrouded parabolic reflector antenna. Low side and rear radiation performance is required in urban or congested areas to minimize interference with other antennas.

Shrouds of other shapes, such as conical shapes are not as effective as cylindrical shrouds whose reflective surface is parallel to the parabolic reflector axis of the antenna system. Conical shaped shrouds serve as extensions of the parabolic reflector surface and exhibits similar diffraction radiation as simple parabolic apertures.

A shrouded parabolic reflector antenna is relatively more expensive to make than one without a shroud. Typically the shroud is supported by the reflector and adds significant weight and wind force loading to the antenna support, which tends to distort the shape of the parabolic reflector and the reflective shroud, losing some of the surface accuracy produced at the factory. With a cylindrical shroud, radiation to the side and rear can be 20 db or more down as compared to an unshrouded antenna, all else being equal. Thus, the cylindrical shroud does not contribute to structural integrity and does not enhance the parabolic reflector surface accuracy. It is employed when much improved radiation directivity is desired over the performance of an unshrouded parabolic reflector antenna.

For sizes larger than about two feet in diameter, high performance antennas suffer the disadvantage of: greater weight, larger shipping and storage volumes, assembly and installation complexities, and greater cost. As a consequence, high performance antennas have been used only for terrestrial point-to-point microwave communication links.

SUMMARY OF THE INVENTION

It is an object to provide a high performance parabolic reflector RF antenna.

It is another object to provide methods and means of improving the performance of a parabolic reflector RF antenna.

It is another object to provide methods and means of reducing reflection of RF energy from the shroud of a high performance parabolic reflector RF antenna to the antenna feed while still retaining the benefits of the shroud.

It is another object to provide a high performance parabolic reflector RF antenna including a reflector, shroud and radome, each comprised of numerous parts that are the same shape and size.

It is another object to provide a high performance parabolic reflector RF antenna including a reflector, shroud and radome, each comprised of numerous parts that are interchangeable.

It is another object to provide a high performance parabolic reflector RF antenna made of molded or stamped parts wherein numerous such parts are interchangeable.

These and other objects and features of the present invention are revealed in the following description of embodiments taken in conjunction with the drawings.

EMBODIMENTS OF THE INVENTION

Parabolic shape adjusting stress post 24 is enclosed within the assembled reflector, radome and shroud along the axis 20 thereof, attached to the inside of the reflector and radome and is adjusted to stress the reflector and radome together.

Octagonal Flat Plate Shroud and Flexible Radome Mechanically Stressed with Parabolic Reflector In a "high performance" parabolic reflector antenna system, according to the present invention, the shroud serves several functions for the antenna system including the following:

1. it is the principal support structure for the reflector and radome;
2. it is the assembly tool that rigidly and accurately locates the reflector and radome in spatial relation so that their parabolic axes are coincident; and
3. it improves the antenna performance by reducing unwanted side and rear radiation characteristics of the antenna.

Figure 4:
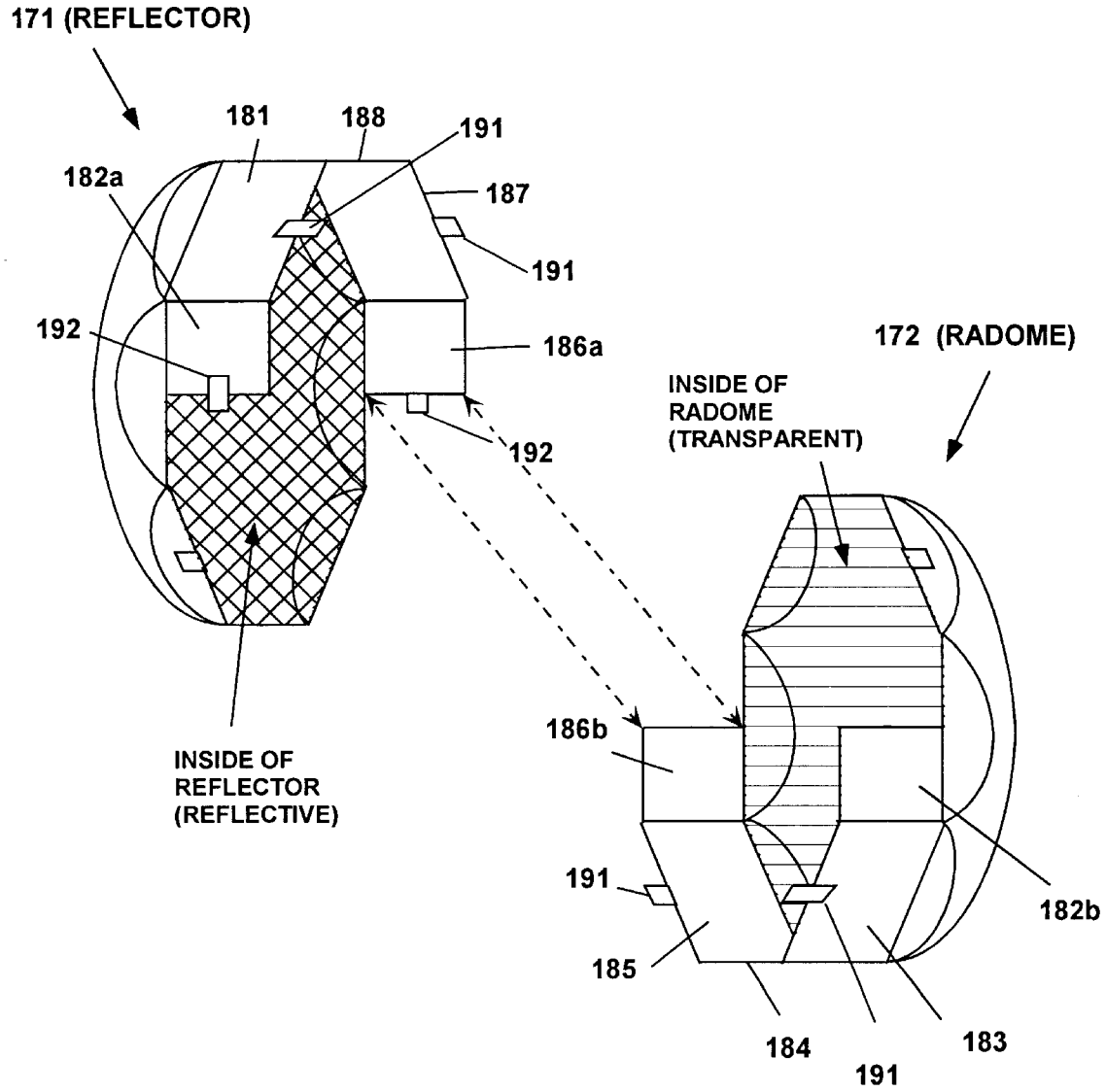
FIG. 4 is an exploded view of a small diameter parabolic reflector antenna of the same general structure as shown in FIG. 1, in which half of the shroud plates are carried by the reflector and half are carried by the radome, for easier, quicker assembly with the stress post, according to the Fifth Embodiment of the present invention.

In this shown by FIGS. 4 and 5, the shroud is an enclosure of four or more flat panels. In this example, there are eight such panels, all the same size, forming an octagon. An electrical advantages of using a segmented shroud of flat plate reflectors is that it minimizes re-radiation degradation. That advantage and others are described below.

The shroud 33 connects and supports the reflector 31 and the radome 32 at their peripheries on axis 30 in an exact spatial relationship for carrying out the parabolic surface forming technique of the present invention using parabolic shape adjusting stress post 34 along axis 30 to improve the parabolic shape of the reflector. Here, as in other embodiments herein, the parabolic reflector body 31 is preferably made of a unitary piece of fiberglass or molded plastic 36 so that it is strong, light weight and uniformally resilient and it has a metal coating 35 in the inside to reflect RF radiation. It could also be made of metal such as by stamping from a single piece to provide the required strength and uniform resilience and then would reflect RF radiation without a special coating, but would probably be heavier than desired. Also, the radome 32 is preferably may be made of the same material 37 as the reflector body and is mechanically the same. The shroud must also provide total support for the antenna system. It consists of eight flat panels that have an electrically conductive surface (RF reflective) and may be joined together using conventional fasteners, hinges, castings, etc., sufficient to provide the necessary structure to support the reflector, radome and feed assembly. Here, the eight flat panels 41 to 48 are connected together by hinges 41*a* to 48*a*.

The number of flat panels (segments) in the shroud 33 assembly is optional. Some mechanical advantages of this type segmented shroud are: low production cost, minimum storage space and shipment cost and light weight. The flat panel segmented shroud also has an electrical advantage over the usual cylindrical shroud. The electrical advantages arise as follows:

1. in the focal plane of the parabolic reflector in an antenna system with a coincident RF feed phase center enclosed by a cylindrical shroud, radiation from the feed, (in the transmission mode), is directly reflected from the cylinder back to the feed (this is called re-radiation degradation;
2. re-radiation degradation is sometimes overcome by lining the internal wall of the cylinder with microwave absorbing material, adding weight cost and other problems;
3. under similar circumstances, using a flat panel segmented shroud, all re-radiation from the shroud panels diverges away from the feed, except that re-radiation from the very limited region perfectly perpendicular to the plane of each flat panel;
4. therefore, with the flat panel segmented shroud re-radiation degradation is imperceptible and added absorbing material is not necessary.

The usual cylindrical shroud design used in the past, for mechanical reasons, requires the length of the cylinder to be greater than electrically necessary to effect the desired reduction in side and rear radiation. The extended length is generally necessary to clear the physical structure of the feed, particularly where pliable planar radomes have been used and wind deflection of the radome causes it to contact (hit) the feed, which reduces antenna performance and reliability.

In this Fourth Embodiment, reflector and radome have the same parabolic shape (and the same geometric focus point). This provides more room inside the antenna for positioning the feed, while still using a minimum length shroud that satisfactorily reduces side and rear radiation. Using a minimum length shroud widens the selection of parabolic curvatures with f/D ratios greater than 0.25 and non-coincident foci. Parabolic antennas in common use have focal lengths, f, chosen by design to provide the highest efficiency for the diameter, D, size required by the feed and the particular application of antenna gain. The relationship between reflector diameter and gain is well known and the present invention applies to any diameter size.

One flat shroud panel 41 has an access port connector 38*b* to facilitate coupling an external transmission line 39 to the axial mounted RF feed 155 transmission line 38*a* inside the shell. The stress post 34 may consists of three separated pieces may for convenience of assembly. The central piece 154 contain the RF feed. The stress post 34 holds the reflector 31 and the radome 32 apart and supports the entire antenna.

Figure 1:
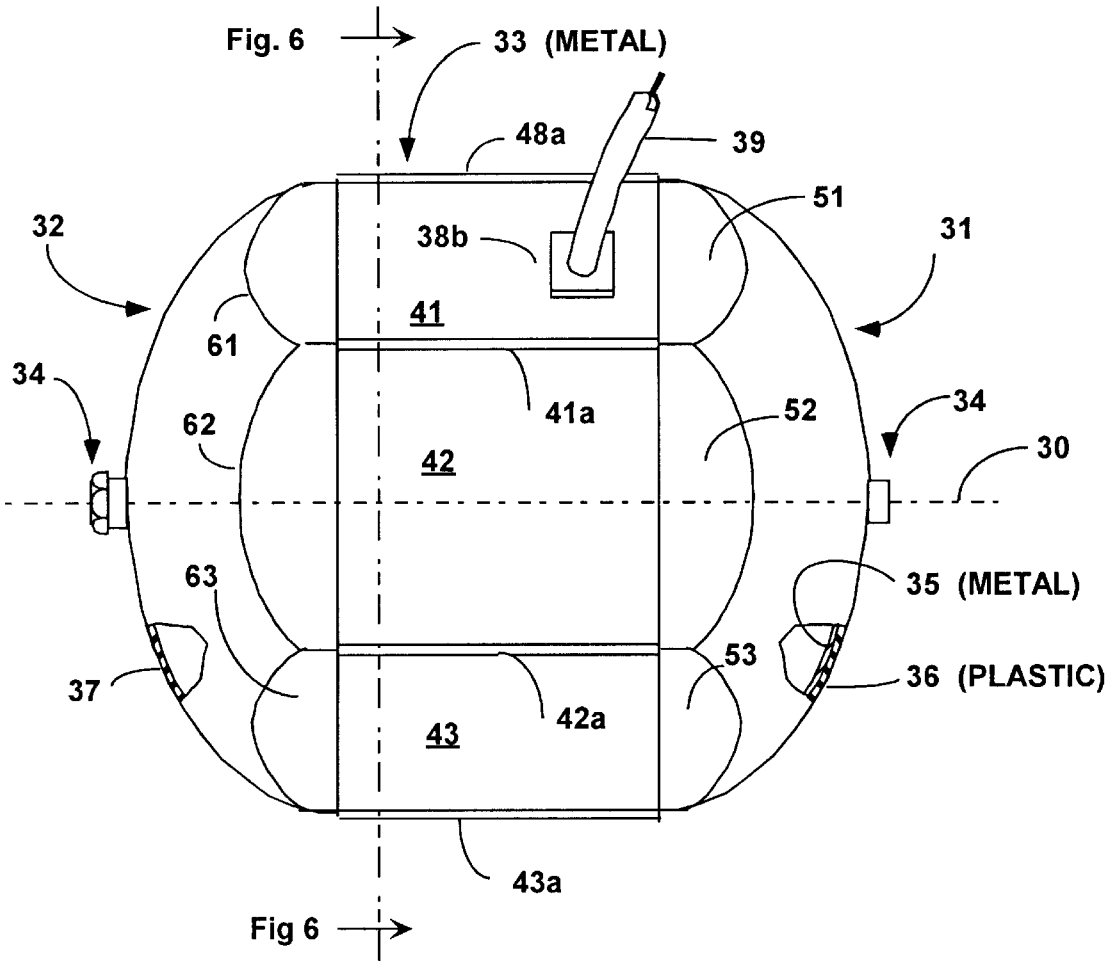
FIG. 1 is a side elevation view of a parabolic reflector antenna with an octagonal flat plate segmented shroud, mechanically matching parabolic reflector and radome for adjusting (distorting) the shape of the reflector surface to make it parabolic using the "parabolic surface forming technique" in the Fourth Embodiment of the present invention.
Figure 2:
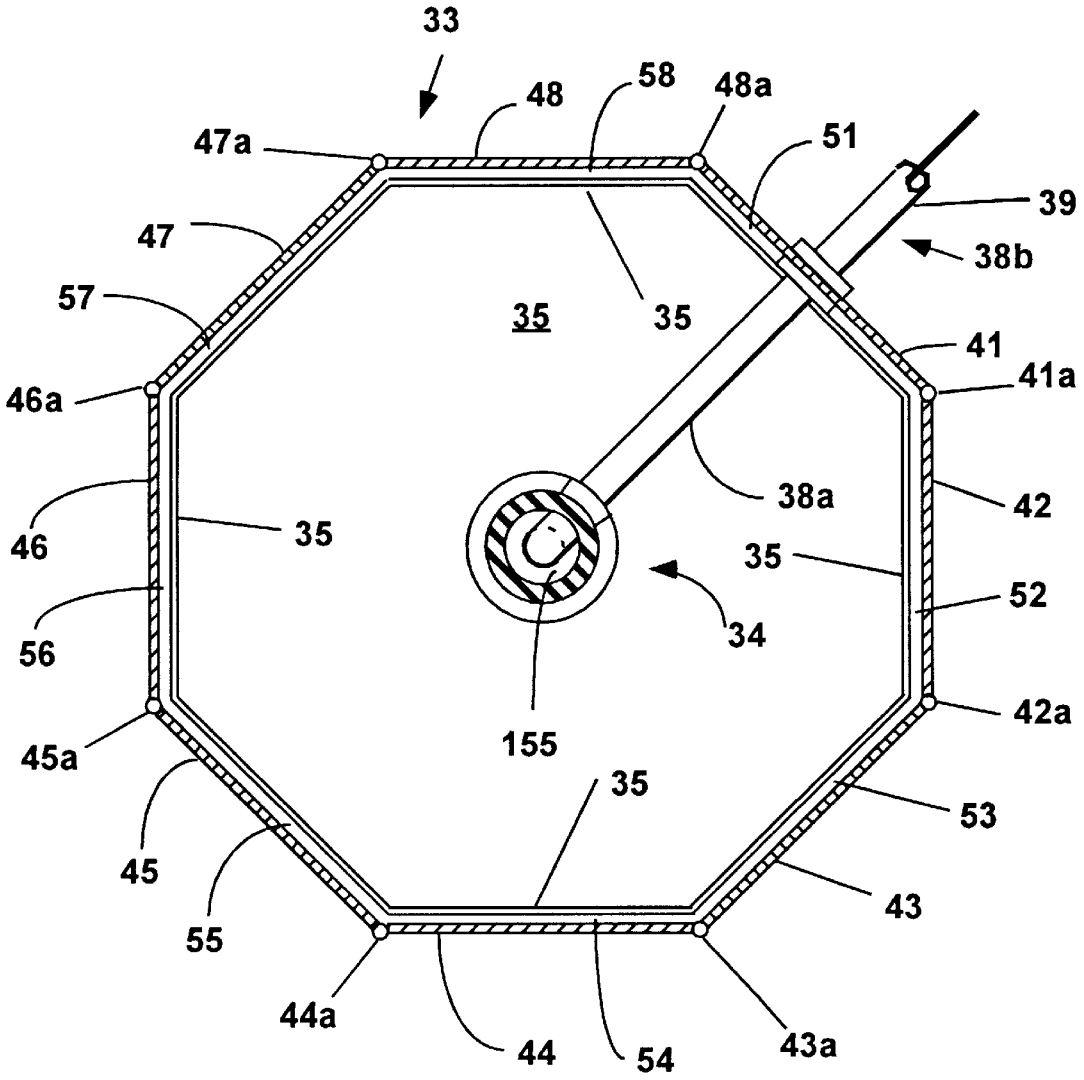
FIG. 2 is a cross-section view of the antenna system of FIG. 1 taken perpendicular to the antenna axis as shown in FIG. 5 and showing the regular octagon shape of the shroud.

The segmented shroud of eight flat panels 41 to 48 shown in FIGS. 1 and 2, according to this Embodiment is particularly applicable for large parabolic reflector antennas. In this example, it requires that the parabolic reflector and radome peripheries be modified from the conventional circular symmetrical shape to one having a matching number of eight flat mounting skirts 51 to 58 parallel to the axis of the system where the reflector or radome meet the shroud. In this embodiment, the eight flat shroud panels and eight flat axial reflector and eight radome mounting panels provide optimum advantages. It is required that these mounting skirts be parallel to the antenna system axis and intersect the corresponding parabolic surface of revolution uniformly about the periphery thereof.

For ease of production, packing, shipping and assembly for operation, the reflector and radome each may be produced in two or more pieces, usually dictated by manufacturing and shipping constraints as well as the overall diameter desired. There is no limit to the number of pieces produced as long as each piece, when assembled, allows uniform application of axial stress throughout the parabolic shaped surfaces of the shell structure. Small size antennas under about four feet in diameter may be fabricated as single piece reflector and radome including the flat planes that match the segmented shroud.

Another Embodiment-With Fewer Parts to Assemble

An optional configuration for small diameter segmented shroud antennas is to mold or form the reflector assembly 171 and radome assembly 172 so each contains half of the segmented shroud flat panels as shown in FIG. 4, a side elevation view of an unassembled antenna. The reflector 171 carries half of the eight segmented shroud panels, panels 181 and half 182*a* of panel 182. The radome 172 carries the other half of the eight segmented shroud panels, like 182*b* and 183. This design requires only a single mold that can be used to make the reflector-skirt assembly and half of the shroud panels and to make the radome-skirt assembly and the other half of the shroud panels. The internal surfaces of the reflector and shroud must be made conductive to reflect RF for proper antenna performance. Metallizing plastic for conductivity is accomplished by a number of well known commercially available techniques.

For any shroud design applicable to small antennas, molding each one half piece of the shell structure to include the complete parabolic shape and half of a shroud can be accomplished in high volume and low cost. Then, simply using the stress post as an axial alignment tool for the reflector and radome facilitates assembly. The two halves slide together along the post and are secured together with latches, such as 191*a*–191*b* and 192*a*–192*b* to complete the shell structure. The feed system is carried inside the post and the transmission line may emerges axially from the reflector rather than through a shroud plate. The remaining task is to attach whatever mount is required for the antenna system to the shroud and connect the external transmission line.

The requirement for high volume, small size microwave antennas offering optimum electrical and mechanical characteristics can be provided in the molded two piece assembly as illustrated in FIG. 4.

Assembly Procedure-Large Antenna

For a large size high performance antenna up to about twelve feet diameter the reflector and radome are preferably each segmented as is the shroud and the segments are all the same (except for reflective coating) and can be made using the same mold or stamp. Moreover, it is convenient if the number of segments making up the reflector (and radome) is the same as the number in the shroud.

Figure 3:
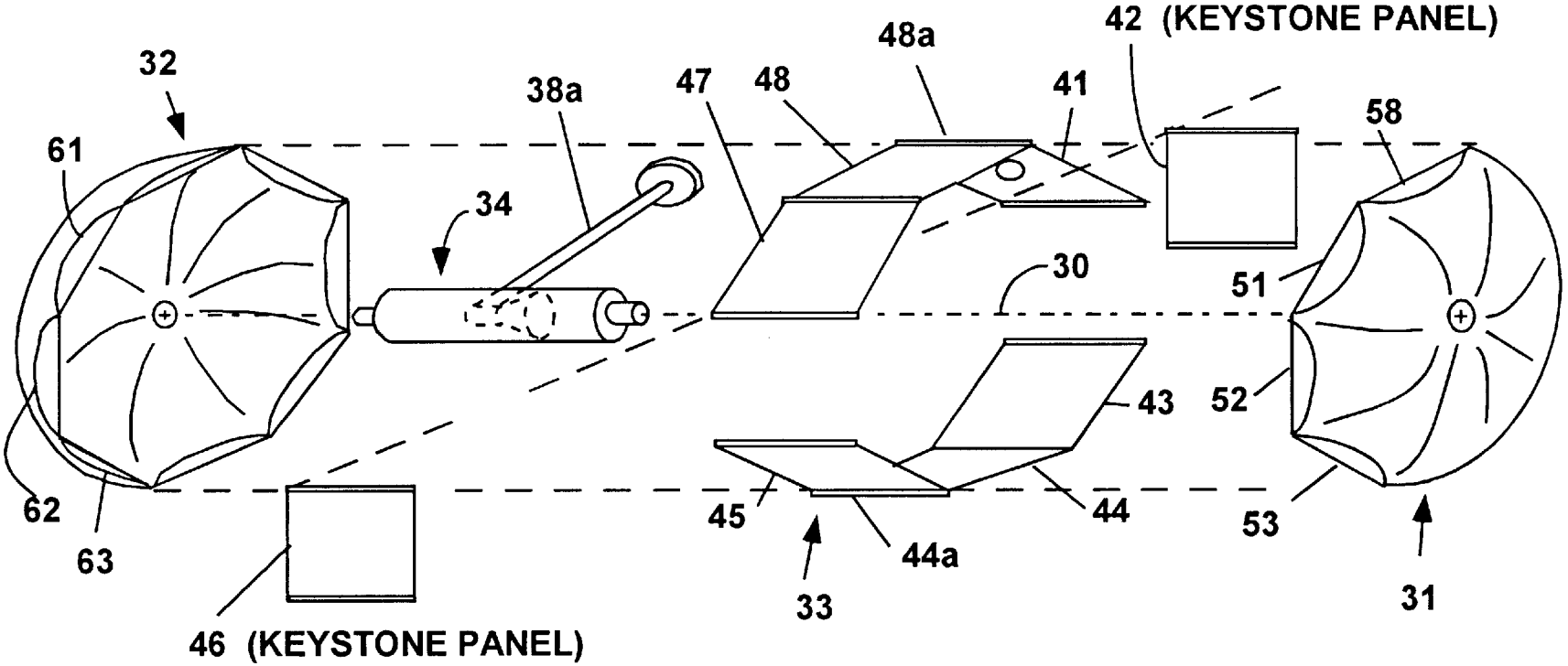
FIG. 3 is an exploded view of the antenna shown in FIG. 1.

Assembly of a large multi-piece reflector and radome and multi segmented shroud is illustrated by FIG. 3 which shows the major parts of the fourth embodiment herein (FIGS. 5 and 6) where the shroud is segmented in eight panels forming an octagon. These major parts are reflector 31, radome 32, shroud 33 and stress post 34 along axis 30 and several of the eight reflector skirts and the eight radome skirts. Here, the reflector and radome are so large that each is assembled from several smaller identical sections. For example each is assembled from eight identical sections. Assembly may be accomplished in the following steps:

Step (a). Connect the eight reflector sections at their central edges and then attach the corresponding eight reflector skirt plates such as 51, 52 and 53 to the edges of the reflector sections and to each other fasten all together using, for example, internal latches;

Step (b). repeat the same procedure as in the above step 1. for the eight radome sections and radome skirt plates such as 61, 62 and 63;

Step (c). holding one group of three hinged flat shroud panels 43, 44 and 45 unfolded and extended in a vertical orientation, fasten them to the corresponding radome skirt plate and reflector skirt plate beginning with the central segment;

Step (d). repeat Step (c) for the second set of three hinged flat shroud panels 47, 48 and 41;

Step (e). this fastening is done after inverting the radome assembly and position it atop the reflector assembly, mating the faces panels of the shroud with the corresponding skirts of the radome and reflector and fastening all six shroud panels to the radome and reflector skirts;

Step (f). the assembly now has structural integrity and may be lifted in an upright position by manual or mechanical means as required by antenna size and after lifting and securing in an upright position, install the feed and stress column as in Steps 1 to 6 above; and connect the transmission line of the feed to its output and input terminations on the antenna;

Step (g). attach the remaining (Keystone) shroud panels 42 and 46 to the reflector and radome skirts and shroud and reflector skirts to complete the shell; and Step (h). apply axial stress to the reflector by screwing in the stress adjusting screw 160 as presribed by design and the reflector/radome curvatures conform to the parabolic shape desired.

I claim:

1. A parabolic reflector antenna for RF radiation comprising, (a) a parabolic reflector body defining a parabolic shaped reflecting surface, a parabolic reflecting surface axis, a parabolic reflecting surface focus and a parabolic reflector body periphery, (b) an RF radiation feed, (c) said parabolic reflecting surface reflecting RF radiation intercepted by said surface from or to said RF radiation feed, (d) a reflective shroud attached to said parabolic reflector body at said periphery thereof and defining a shroud axis that is coincident with said parabolic reflecting surface axis, (e) said shroud defines a shroud radiation aperture and (f) said shroud is comprised of several flat reflective surfaces oriented perpendicular to radial lines that are perpendicular to said shroud axis, (g) whereby most RF radiation intercepted by said shroud flat reflective surfaces from or to said RF radiation feed is not reflected thereby to said feed.

2. A parabolic reflector antenna as in claim 1 wherein, said shroud aperture is covered by a radome that is transparent to RF radiation.

3. A parabolic reflector antenna as in claim 2 wherein, (a) said parabolic reflector body, said shroud, and said radome define a shell enclosing said RF radiation feed.

4. A parabolic reflector antenna as in claim 1 wherein, (a) said shroud flat reflective surfaces are flat plates.

5. A parabolic reflector antenna as in claim 4 wherein, (a) said shroud flat plate reflective surfaces are substantially all the same size and shape and are connected together end to end to form said shroud.

6. A parabolic reflector antenna as in claim 5 wherein, (a) said shroud as viewed along said shroud axis defines a polygon.

7. A parabolic reflector antenna as in claim 5 wherein, (a) said shroud as viewed along said shroud axis defines a regular polygon.

8. A parabolic reflector antenna as in claim 5 wherein, (a) said shroud as viewed along said shroud axis defines a polygon of at least four sides.

* * * * *